US007275916B2

(12) United States Patent
Smith et al.

(10) Patent No.: US 7,275,916 B2
(45) Date of Patent: Oct. 2, 2007

(54) INTEGRATED ENGINE/COMPRESSOR CONTROL FOR GAS TRANSMISSION COMPRESSORS

(75) Inventors: Jack A. Smith, Spring Branch, TX (US); James J. Cole, Helotes, TX (US); Gary D. Bourn, San Antonio, TX (US); Ralph E. Harris, San Antonio, TX (US); Anthony J. Smalley, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 271 days.

(21) Appl. No.: 10/720,767

(22) Filed: Nov. 24, 2003

(65) Prior Publication Data

US 2005/0111997 A1 May 26, 2005

(51) Int. Cl.
*F04B 49/00* (2006.01)

(52) U.S. Cl. ..... 417/53; 417/34; 417/280

(58) Field of Classification Search ..... 417/26, 417/28, 29, 34, 278, 280, 364, 53
See application file for complete search history.

(56) References Cited

U.S. PATENT DOCUMENTS

| | | | | |
|---|---|---|---|---|
| 1,616,991 | A * | 2/1927 | Redfield | 417/277 |
| 4,330,237 | A | 5/1982 | Battah | 417/2 |
| 4,496,286 | A * | 1/1985 | Gagnon | 417/22 |
| 4,961,691 | A | 10/1990 | Waldrop | 417/237 |
| 5,224,836 | A | 7/1993 | Gunn et al. | 417/14 |
| 5,967,757 | A | 10/1999 | Gunn et al. | 417/34 |
| 5,997,259 | A * | 12/1999 | Marshall et al. | 417/349 |

* cited by examiner

*Primary Examiner*—Anthony Stashick
*Assistant Examiner*—Vikansha Dwivedi
(74) *Attorney, Agent, or Firm*—Baker Botts LLP

(57) ABSTRACT

A method and system for controlling an engine that drives a reciprocating compressor, such as the large compressors used for natural gas transmission. A controller receives data from the compressor representing operation conditions, such as load step, suction pressure, and discharge pressure. The controller then calculates engine control parameters, such as air intake and spark timing, based on the compressor data to optimize engine performance and emissions.

32 Claims, 2 Drawing Sheets

INTEGRATED ENGINE/COMPRESSOR CONTROL FOR GAS TRANSMISSION COMPRESSORS

TECHNICAL FIELD OF THE INVENTION

This invention relates to large compressor/engine units for transporting natural gas, and more particularly for the control systems for this type of compressor unit.

BACKGROUND OF THE INVENTION

Most natural gas consumed in the United States is not produced in the areas where it is most needed. To get gas from increasingly remote production sites to consumers, pipeline companies operate and maintain hundreds of thousands of miles of main transmission lines. This gas is then sold to local distribution companies, who deliver gas to consumers using a network of more than a million miles of local distribution lines. This vast underground transmission and distribution system is capable of moving many billions of cubic feet of gas each day. To provide force to move the gas, and to improve the economics of gas transportation, operators install large compressors at transport stations along each pipeline.

These compressors can be driven by various engines and motors. Compressors driven by natural gas engines have proved to reduce power demand and energy consumption costs, as compared to compressors driven by other means. An advantage of these engines is that they are driven by the same natural gas as is being transported by the compressor.

Conventionally, the control systems for the engine and compressor are isolated from each other. That is, the engine control system does not receive data about what the compressor control system is doing, and vice versa.

SUMMARY OF THE INVENTION

One aspect of the invention is a method of controlling an internal combustion engine that drives a reciprocating gas compressor. It is assumed that the compressor's output is controlled by specifying "load steps" for its cylinders. A "integrated" engine/compressor controller receives various compressor operating values, which include at least the compressor load step for each cylinder, the compressor suction pressure, and the compressor discharge pressure. Optionally, the controller may also receive various engine operating values.

Based on these operating values, the controller calculates engine and/or compressor control parameters. Many different control parameters are possible as outputs from the controller, but typically the controller will control at least the air flow to the engine. Other likely control parameters include spark timing for engine ignition, and various engine fuel parameters.

The controller can be programmed to provide these parameters on the basis of any desired engine optimization. For example, the engine control parameters can be calculated so as to maximize engine efficiency and/or minimize emissions.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Figure 1:
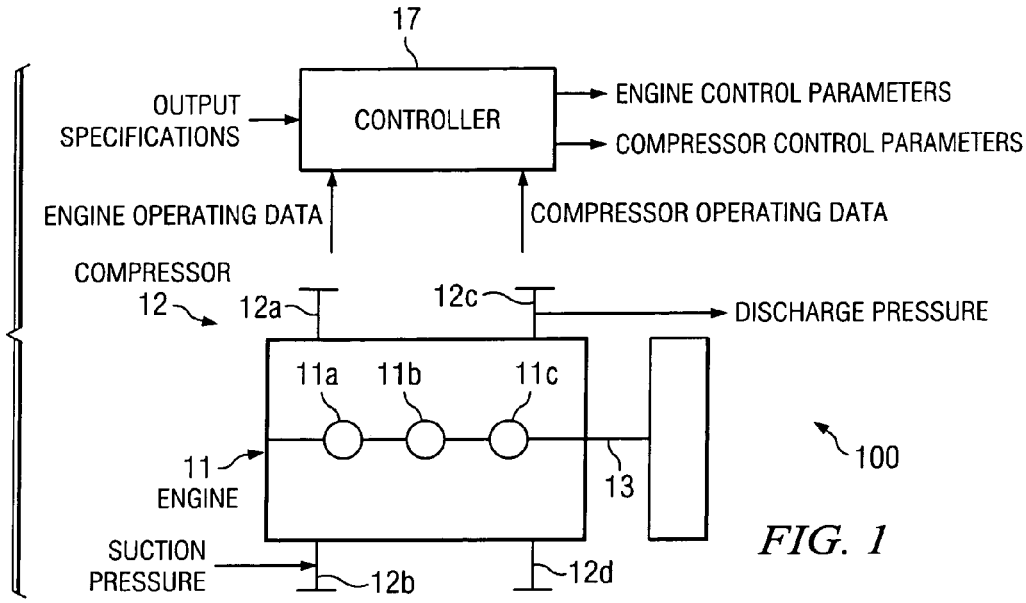
FIG. 1 illustrates an engine-driven compressor system having a integrated engine/compressor controller in accordance with the invention.

FIG. 1 illustrates an engine-driven compressor system 100, having an integrated engine/compressor controller 17 in accordance with the invention. Compressor system 100 is an "integrated engine-compressor system" in the sense that its engine 11 and compressor 12 share the same crankshaft 13.

The engine 11 is represented by three engine cylinders 11*a*-11*c*. The compressor 12 is represented by four compressor cylinders 12*a*-12*d*. In practice, engine 11 and compressor 12 may each have many more cylinders.

Figure 2:
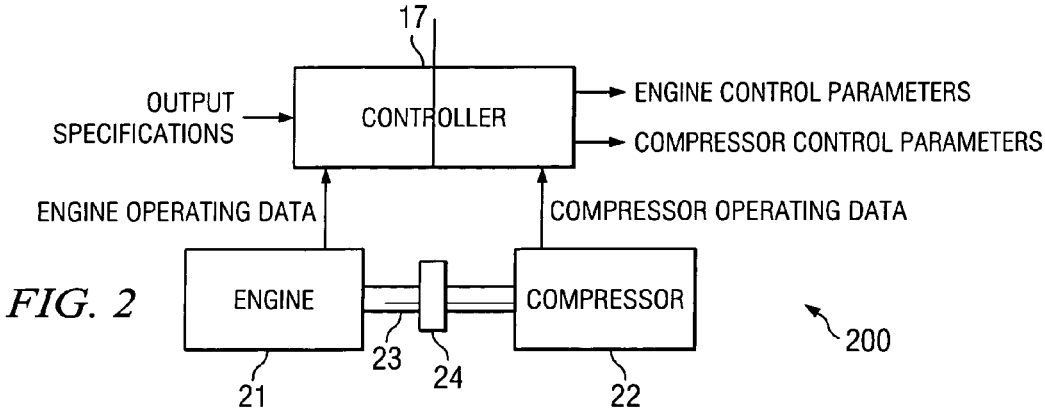
FIG. 2 illustrates a compressor system in which the engine and compressor are separable, but with which the controller of FIG. 1 may also be used.

FIG. 2 illustrates a compressor system 200 in which the engine 21 and compressor 22 are separate units. This engine/compressor configuration is referred to herein as a "separable engine-compressor system". The respective crankshafts 23 of engine 21 and compressor 22 are mechanically joined at a gearbox 24, which permits the engine to drive the compressor.

As indicated in the Background, a typical application of gas compressor systems 100 and 200 is in the gas transmission industry. Both systems 100 and 200 are characterized by having a reciprocating compressor 13 or 23, whose output is controlled by specifying "load steps' for its compressor cylinders. For purposes of this description, the engine cylinders are referred to as the "power cylinders" of system 100 or system 200.

The following description is written in terms of the integrated system 100 and its components. The same concepts are applicable to system 200; as indicated in FIGS. 1 and 2, the same controller 17 may be used with either type of system.

Controller 17 is equipped with processing and memory devices, appropriate input and output devices, and an appropriate user interface. It is programmed to perform the various control tasks described herein, and deliver control parameters to the engine 11 and compressor 12.

Controller 17 receives output specifications that specify operating parameters, such as a desired discharge pressure for compressor 100. It also receives operating data from engine 11 and compressor 12. This input data may be measured data from various sensors (not shown) or data from other control devices associated with engine 11 or compressor 12.

As explained below, controller 17 adjusts various engine control parameters that are affected by compressor load step variations and the resulting variations in the load induced on the engine crankshaft by the compressor. These engine parameters may be adjusted to maximize engine operation in terms of combustion and emissions. Given the input data, output specifications, and control objectives described herein, algorithms for programming controller 11 may be developed and executed.

In the examples of FIGS. 1 and 2, controller 17 controls engine 11 and compressor 12 directly. In other embodiments, controller 17 could be remote from the engine/compressor equipment, and control parameters could be delivered over a data communications link, such as a network. A networked link of this type would permit the networking of a controller 17 with a remote station control system.

As indicated in the Background, internal combustion engine 11 is used as the compressor driver. That is, the engine's horsepower is unloaded through the compressor. In the example of this description, engine 11 is a natural gas engine, but the same concepts could apply to engines using other fuels.

Compressor 12 operates between two gas transmission lines. A first line, at a first pressure, is referred to as the suction line. A second line, at a second pressure, is referred to as the discharge line. Typically, the suction pressure and discharge pressure are measured in psi (pounds per square inch). In practical application, gas flow is determined by specifying a desired flow in terms of psi on the discharge line.

The power requirement of the gas compressor 100 is adjusted in terms of "load steps". Load steps are achieved by using discrete unloaders, such as the "load pockets" described below, or by using infinitely variable (stepless) unloaders. The term "load step" as used herein encompasses the parameter for specifying power requirements of any of these types of compressor unloaders.

Figure 3:
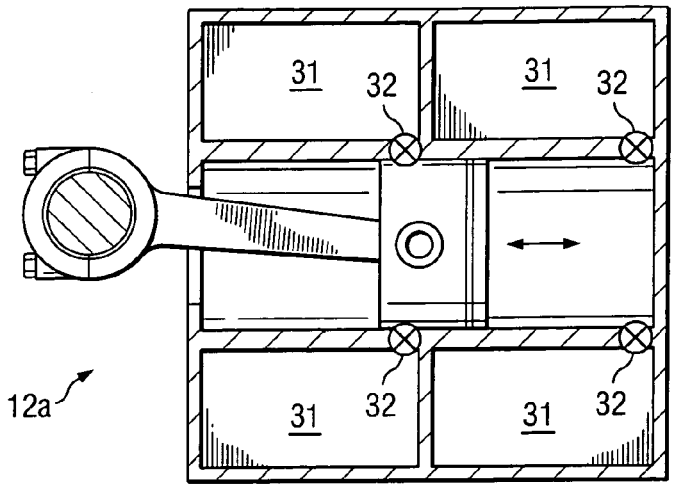
FIG. 3 illustrates one of the compressor cylinders of FIG. 1, with load pockets and load valves used for load step control.

FIG. 3 illustrates one of the compressor cylinders 12*a*-12*d* of FIG. 1, with load pockets and load valves used for load step control. Each end (head and crank) of cylinder 12*a* has two load pockets 31. A valve 32 is used to either open or close the opening between the pocket 31 and the cylinder. In this example, each of four load pockets 31 has a capacity of one-quarter of the gas compressed by cylinder 12*a* in one stroke. The pockets change the compression ratio of the compressor 12, and thus the power required by the engine 11 to drive the compressor cylinders.

As engine 11 operates, the load on engine 11 induced by compressor 12 continually varies over the engine cycle. Factors that contribute to the instantaneous load on the engine crankshaft 13 include the phasing between the power cylinders and the compressor cylinders, the number of compressor cylinders, the compressor type (i.e., whether single acting, double acting, etc.), the unit loading scheme, and the number of discrete load steps.

Some power cylinders carry larger loads than others based on a particular load step. An engine crankshaft load that is poorly distributed among the power cylinders 11*a*-11*c* can lead to poor engine performance and to crankshaft failure.

For automotive engines, studies have shown that the instantaneous crank angle velocity (ICAV) decreases for a brief period of time as the power cylinder piston approaches top-dead-center (TDC) during its compression stroke. The piston is then accelerated during the power stroke following combustion. Likewise, for gas compressor engines such as engine 11, studies have shown that ICAV decreases as the power cylinders approach TDC. This effect is exacerbated with the addition of the compressor-induced load, a load that varies throughout the engine cycle.

The number and geometric arrangement of the compressor cylinders 12*a*-12*d* relative to the power cylinders 11*a*-11*c* directly influences the acceleration and deceleration of some power cylinders relative to others. For example, if all compressor cylinders are loaded equally, and if the geometrical arrangement is such that a compressor cylinder is nearing TDC at or near the same time as an power cylinder, that power cylinder will experience more deceleration.

Figure 4:
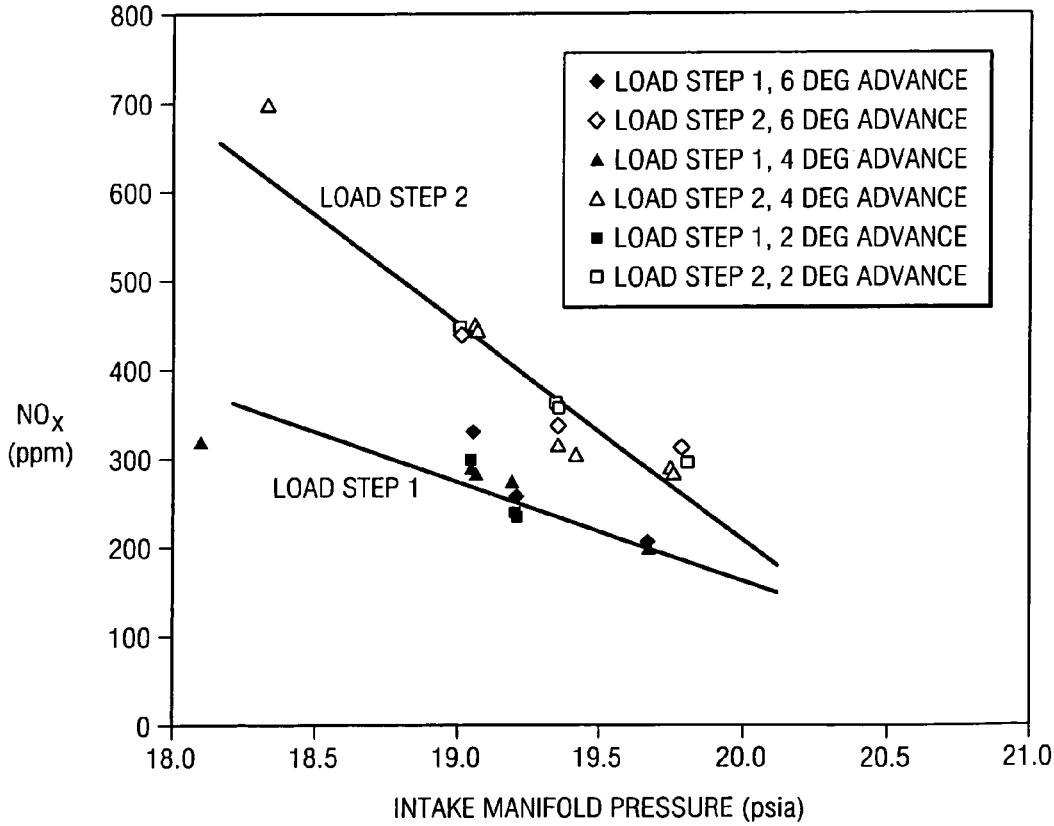
FIG. 4 illustrates how compressor load steps affect the engine in terms of its NOx emissions and thermal efficiency.

FIG. 4 illustrates how compressor load steps affect engine 11 in terms of its NOx emissions and thermal efficiency. The test resulting in the data of FIG. 4 was performed for an engine 11 having a constant load, but at different compressor load steps.

The test represented by FIG. 4 is based on the principle that engine horsepower is proportional to the flow pressure difference and the compressor load step (LS). In other words: $HP \propto P_{discharge} - P_{suction}$, LS. The same engine horsepower can be achieved by varying the load step as the suction pressure changes. The difference between two load steps (Load Step 1 and Load Step 2) was the deactivation of a head end pocket in one of four compressor cylinders coupled to an inline six-cylinder engine. As illustrated, the slopes of MAP (manifold intake pressure) versus NOx emissions are different for different load steps.

As further indicated in FIG. 4, the NOx emissions varied between the two load steps for several spark timings, even though the load on the engine remained the same. For each load step, the spark timings were 2, 4, and 6 degrees before TDC (top dead center).

At Load Step 1, all cylinders have equal clearance volume; all load pockets are closed. In Load Step 2, an additional 1410 cubic inches of clearance volume was created by the deactivation of the head end pocket in one of the compressor cylinders. The deactivation unloads one or more power cylinders because the gas in that compressor cylinder is being compressed to a lower pressure than the gas in the other compressor cylinders.

The test results illustrated in FIG. 4, and the results of similar tests, indicate that air and/or fuel flow is sufficiently perturbed by uneven compressor loads so as to cause changes in engine combustion characteristics. This belies the conventionally held belief that engine combustion characteristics are substantially similar so long as the overall engine load (horsepower) remains the same.

The present invention is based on a principle of providing fuel flow and spark timing modulation among power cylinders for the purpose of compensating for unevenly distributed compressor loads or load steps.

An important engine control compensation is normally for fuel flow, due to the varying air flow caused by the speeding up and slowing down of the engine crankshaft during the engine cycle. This leads to increased or decreased air charging in two stroke engines because the engine piston speed increases and decreases, leading to longer or shorter times that the intake ports are open for air scavenging. If fuel flow is constant for all power cylinders, the trapped air-fuel ratio is not constant among the power cylinders. However, if fuel flow and ignition timing compensations are made, similar combustion characteristics across the power cylinders can be achieved.

To this end, controller 17 receives various input data representing operating conditions of engine 11 and compressor 12. Controller 17 then processes this data to determine various control parameters for engine 11 and compressor 12.

Input data from engine 11 may include, without limitation: engine speed, intake manifold air pressure and temperature, engine coolant temperature, exhaust back pressure, pre-turbine pressure, exhaust gas NOx concentration, exhaust gas oxygen (O2) concentration, air flow to engine, fuel flow to engine, ignition system energy, as well as other inputs required to optimize engine control. Input data from compressor 12 may include, without limitation: load steps on each cylinder, suction pressure, discharge pressure, and suction and discharge temperatures.

Controller 17 is programmed with engine control algorithms that optimize performance of engine 11, based on compressor load step conditions and other performance data. Compressor load step algorithms are based on desired pipeline pressure or flow throughput, with the goal of balancing compressor loads across the engine and/or minimizing the effects of unbalanced compressor loads on engine performance. Typically, engine optimization is in terms of fuel consumption and exhaust emissions. However, controller 17 may be programmed to achieve any combination of one or more engine optimization goals.

Various engine control parameters that are subject to control by controller 17 include, without limitation: and ignition timing, the number of spark/ignition events per cycle and per power cylinder, fuel quantity, fuel injection or admission timing per cycle and per power cylinder, the number of fuel injection events per firing event, global and per cylinder pre-chamber fueling quantity, global and per cylinder pre-chamber fueling rate, global and per cylinder pre-chamber fuel pressure, global and per cylinder air-to-fuel and equivalence ratio, air flow to the engine (intake manifold pressure), and turbocharger wastegate parameters. Additionally, if engine 11 is equipped with pilot injectors, controller 17 may control the pilot injection quantity and/or timing per cycle and per power cylinder.

Various compressor control parameters that are subject to control by controller 17 include, without limitation: compressor load step, compressor pocket position, compressor load step sequence, compressor suction and/or discharge bottle conditions, and pipeline yard conditions.

For both the engine and compressor, controller 17 may be programmed to determine the various control parameters for steady state and/or transient engine conditions. More specifically, during actual engine operation, the engine is often operating under transient conditions regarding load and speed. For example, during steady state conditions, there is a balance between the fuel flow from the injectors and the fuel flow to the cylinders which is not present during transient conditions. One of the challenges of engine control is to provide constant control parameters, such as a constant air to fuel ratio, despite the difficulty of measuring the air-to-fuel response of the engine under transient conditions. This type of engine control is sometimes referred to as "transient compensation".

Additionally, the control parameters for engine 11 may be on a "global" or per cylinder basis. If desired, input data representing a current engine or compressor current operating condition can be used to determine a control parameter for that same operating condition, such that controller 17 acts in the manner of a feedback controller.

What is claimed is:

1. A method of controlling an internal combustion engine that drives a reciprocating gas compressor having multiple cylinders, comprising:

receiving compressor operating values, the compressor operating values being at least values representing the load for each cylinder, the compressor suction pressure, and the compressor discharge pressure; and calculating engine control values, based on the compressor operating values;

wherein the calculating step is performed using an algorithm that receives input to determine whether the loads among the cylinders are balanced, and if not, compensates the engine control value for unevenly distributed cylinder loads.

2. The method of claim 1, wherein the engine has pilot injectors, and wherein the engine control values control the pilot injectors.

3. The method of claim 2, wherein the pilot injector control values are determined per cylinder.

4. The method of claim 1, further comprising the step of receiving at least one engine operating value, and wherein the calculating step is further based on the engine operating value.

5. The method of claim 4, wherein the engine operating value is from the group of: engine speed, intake manifold air pressure, intake manifold air temperature, engine temperature, exhaust back pressure, pre-turbine pressure, exhaust gas composition, air flow, fuel flow, and ignition system energy.

6. The method of claim 1, further comprising the steps of calculating compressor control parameters, the compressor control parameters representing at least compressor load steps.

7. The method of claim 1, further comprising the step of communicating engine control values over a network.

8. The method of claim 1, wherein the calculating step provides steady state engine control.

9. The method of claim 1, wherein the calculating step provides transient compensation of engine control parameters.

10. A method of controlling an internal combustion engine that drives a reciprocating gas compressor having multiple cylinders, comprising:

receiving compressor operating values, the compressor operating values being at least values representing the load for each cylinder, the compressor suction pressure, and the compressor discharge pressure;

receiving at least one engine operating value from the group of: engine speed, intake manifold air pressure, intake manifold air temperature, engine temperature, exhaust back pressure, pre-turbine pressure, exhaust gas composition, air flow, fuel flow, and ignition system energy; and calculating engine control values, based on the compressor operating values;

wherein the calculating step is performed using an algorithm that receives input to determine whether the loads among the cylinders are balanced, and if not, compensates the engine control value for unevenly distributed cylinder loads.

11. A controller for controlling an internal combustion engine that drives a reciprocating gas compressor having multiple cylinders, comprising:

circuitry for receiving compressor operating values, the compressor operating values being at least values representing the load for each cylinder, the compressor suction pressure, and the compressor discharge pressure; and circuitry for calculating engine control value, based on the compressor operating values;

wherein the calculating step is performed using an algorithm that receives input to determine whether the loads among the cylinders are balanced, and if not, compensates the engine control value for unevenly distributed cylinder loads.

12. The method of claim 1, wherein the engine control values are engine spark timing values.

13. The method of claim 12, wherein the engine spark timing is determined per cycle.

14. The method of claim 12, wherein the engine spark timing is determined per cylinder.

15. The method of claim 1, wherein the engine control values are fuel quantity values.

16. The method of claim 1, wherein the engine control values are fuel injection timing or spark timing values.

17. The method of claim 16, wherein the timing values are determined per cycle.

18. The method of claim 16, wherein the timing values are determined per cylinder.

19. The method of claim 1, wherein the engine control values are pre-chamber fueling quantity values.

20. The method of claim 19, wherein the pre-chamber fueling quantity is determined per cylinder.

21. The method of claim 1, wherein the engine control values are pre-chamber fuel pressure values.

22. The method of claim 21, wherein the pre-chamber fuel pressure is determined per cylinder.

23. The method of claim 1, wherein the engine control values are air-to-fuel ratio values.

24. The method of claim 23, wherein the air-to-fuel ratio is determined per cylinder.

25. The method of claim 1, wherein the engine has a turbocharger, and wherein the engine control values are turbocharger control values.

26. The method of claim 10, further comprising the steps of calculating compressor pocket positions, based on the engine operating values.

27. The method of claim 10, further comprising the steps of calculating compressor load step sequences, based on the engine operating values.

28. The method of claim 10, further comprising the steps of calculating compressor suction conditions, based on the engine operating values.

29. The method of claim 10, further comprising the steps of calculating compressor discharge conditions, based on the engine operating values.

30. The method of claim 1, wherein the calculating step is further based on input data representing engine efficiency.

31. The method of claim 1, wherein the calculating step is further based on input data representing engine emissions.

32. The method of claim 1, wherein the engine control values are air flow quantity values.

* * * * *